US006117022A

United States Patent [19]

Crawford et al.

[11] Patent Number: 6,117,022

[45] **Date of Patent: *Sep. 12, 2000**

[54] LIGHTWEIGHT GOLF CLUB WITH ELASTOMERIC HEAD

[75] Inventors: William C. Crawford, Baltimore; Jackie L. Davis, Aberdeen, both of Md.

[73] Assignee: STX LLC, Baltimore, Md.

[ * ] Notice: This patent issued on a continued prosecution application filed under 37 CFR 1.53(d), and is subject to the twenty year patent term provisions of 35 U.S.C. 154(a)(2).

[21] Appl. No.: 08/319,004

[22] Filed: Oct. 6, 1994

Related U.S. Application Data

[63] Continuation-in-part of application No. 08/135,555, Oct. 14, 1993, abandoned.

[51] Int. Cl.[7] ..... A63B 53/04

[52] U.S. Cl. ..... 473/324; 473/329; 473/332; 473/349; 473/350; 273/DIG. 30

[58] Field of Search ..... 273/186.2, 187.4, 273/187.6, 193 R, 194 R, 77 R, 162 R, 164.1, 80.2–80.9, 167 R–77 A, 80 R, DIG. 7, DIG. 8, DIG. 23, DIG. 30; 29/460, 508, 527.3, 527.4; 264/46.7, 328.16; 473/324–350, 409

[56] References Cited

U.S. PATENT DOCUMENTS

| | | | |
|---|---|---|---|
| 1,222,770 | 4/1917 | Kaye | 273/167 J |
| 1,602,567 | 10/1926 | Colwell | 273/78 |
| 1,768,792 | 7/1930 | Schavoir | 273/78 |
| 1,867,103 | 7/1932 | Schavoir | 273/78 |
| 1,983,158 | 12/1934 | Young | 273/80.4 |
| 2,846,228 | 8/1958 | Reach | 273/173 |
| 3,266,805 | 8/1966 | Bulla | 273/169 |
| 4,244,576 | 1/1981 | Mosier | 273/162 E |
| 4,697,814 | 10/1987 | Yamada . | |
| 4,728,105 | 3/1988 | Kobayashi | 273/173 |
| 5,269,517 | 12/1993 | Petrucelli | 273/78 |
| 5,333,871 | 8/1994 | Wishon . | |

FOREIGN PATENT DOCUMENTS

| | | | |
|---|---|---|---|
| 2094 | 3/1932 | Australia | 273/80.2 |
| 266320 | 10/1964 | Australia | 273/80.2 |
| 2173113A | 10/1986 | United Kingdom . | |

*Primary Examiner*—Sebastiano Passaniti
*Attorney, Agent, or Firm*—Connolly Bove Lodge & Hutz LLP

[57] ABSTRACT

A golf club having an elastomer head which is easily constructed of relatively inexpensive components making the club particularly suitable as an introductory golf club for teaching the game of golf to youths, is described. The club comprises a metal insert configured to a desired shape, an elastomeric material molded around the metal insert, and a pad at the back of the striking head. A shaft is attached to the metal insert.

11 Claims, 2 Drawing Sheets

14
12
10
7
7
20
24
30
22
24
22
12
24
22
24
12
22
24
30
30
34
32

LIGHTWEIGHT GOLF CLUB WITH ELASTOMERIC HEAD

RELATED APPLICATION

This application is a continuation-in-part of application Ser. No. 08/135,555 filed Oct. 14, 1993 now abandoned.

FIELD OF THE INVENTION

This invention relates to a lightweight golf club. More particularly, the invention relates to a golf club having an elastomeric head which is easily constructed of relatively inexpensive components, making the club particularly suitable as an introductory club for teaching the game of golf to youths. The club is relatively safe, including when used in indoor play.

BACKGROUND OF THE INVENTION

The popularity of the golf game in the United States and other countries throughout the world is universally accepted. Because of its extreme popularity, the market for golf clubs is extensive with each producer of golf clubs striving to provide clubs having unique characteristics to enhance the popularity of its own brand of clubs.

Although golf is tremendously popular, most beginners learn the game of golf utilizing clubs designed for the experienced player. As is recognized, golf clubs in order to serve their function of driving a golf ball must have a head constructed of either wood or metal at the end of a long shaft. As such, the club can be of some danger if improperly used or if used in an area where the golfers are closely spaced.

More recently, in an effort to promote the game of golf, the desirability of having a golf club designed primarily for teaching young golfers the game of golf, for example in a gym class in school or other indoor environment, was recognized. A primary concern with respect to a golf club for this teaching purpose is that it be relatively safe for use by an inexperienced or beginner golfer, including in a confined area suitable for teaching a number of youths the game of golf in a common class. Although golf clubs which have a cushioned head surface designed for training youths are known, for example from Petruccelli et al, U.S. Pat. No. 5,186,914, such clubs are disadvantageous in that the clubs do not realistically simulate conventional golf clubs.

Accordingly, there is a substantial need for a golf club design and method of construction which provides a teaching club light in weight and relatively safe that closely approximates the feel, play and appearance of a conventional golf club, and which can be inexpensively manufactured.

OBJECTS AND SUMMARY OF THE INVENTION

It is a primary object of the present invention to provide a lightweight golf club which has a head which, although having the configuration of a conventional golf club, is of a resilient material and designed for relative safety.

It is another object of the present invention to provide a lightweight golf club which is essentially similar to a conventional golf club meeting golf club standards, but which can be modified for safety features for use in youth training groups.

It is another object of this invention to provide, in combination, component materials to promote the teaching of the game of golf with the introductory club of the present invention.

The objects of the present invention are obtained by constructing a golf club, for example, having the configuration of a 7-iron, wherein an elastomeric material such as a polyurethane is molded around a metal insert configured to provide the configuration of the club desired, such as the 7-iron, with that head having an area at the back of the striking face of the club for receiving a material more resilient or softer than the striking face. Alternatively, the back of the striking face can have a hook and loops fastening material sold under the tradename VELCRO (hereinafter "VELCRO") applied thereto to pick up a mated training ball. The metal insert is attached to a suitable golf club shaft, for example a conventional golf club shaft. The resultant golf club has a weight below about 12 ounces, preferably in the range of 9–12 ounces, and optimally a weight of 10½ ounces. Because of its unique characteristics, the golf club is relatively safe and can be used in play in confined areas by inexperienced golfers, permitting the club to be safely used in indoor and outdoor teaching classes.

THE DRAWING AND DETAILED DESCRIPTION

Figures 1, 2, 3, 4, 5, 6, 7:
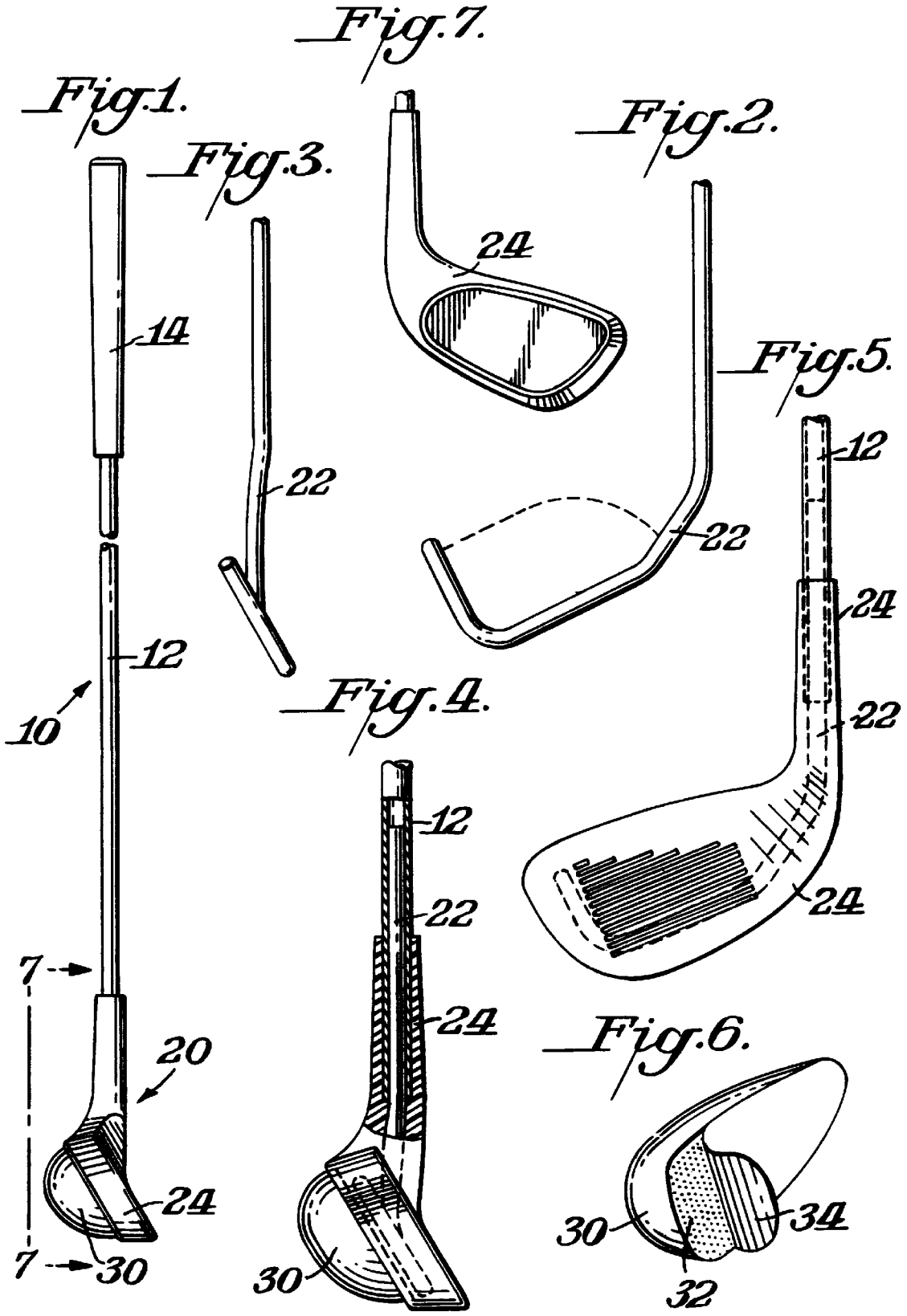
FIG. 1 is an elevational view of the leading edge of the golf club of the present invention.
FIG. 2 is a side view of the metal insert used in the golf club of FIG. 1.
FIG. 3 is an elevational view of the leading edge of the metal insert of FIG. 2.
FIG. 4 is an elevational view, partly in section, of the lower end of the leading edge of the golf club of FIG. 1.
FIG. 5 is a partial elevational view of the lower end of the golf club of FIG. 1 viewed from the face of the club, with the metal insert shown in broken lines.
FIG. 6 is a perspective view of a replaceable pad with an adhesive protective sheet partly stripped away.
FIG. 7 is a view along line 7—7 of FIG. 1 without the pad which is illustrated in FIGS. 1 and 6.

Referring to the drawing, FIG. 1 illustrates a golf club 10 according to the present invention comprising a head 20, a shaft 12, an a shaft grip 14. The head 20 comprises a metal rod insert 22 configured into a plurality of angles to provide the configuration of a desired club which, according to the preferred embodiment shown in the drawing, is a 7-iron. An elastomeric material 24 is molded around metal insert 22 to have the desired configuration, including the loft angle and configuration of a 7-iron. The elastomeric material can be of any resilient and tough elastomeric material such as a polyurethane, a carboxylated nitrile, and the like. As best shown in FIG. 7, the surface of resilient head 24 has a recess 26 at the surface opposite of the striking face for receiving a resilient elastomeric insert 30. Preferably, the elastomeric insert 30 is replaceable to provide a club having an insert of different degrees of softness. As will be described more fully hereinafter, the recessed area can, alternatively, receive a VELCRO layer.

As shown in FIG. 6, replaceable inserts 30 can have a protective sheet 34 covering an adhesive surface 32 of resilient member 30. When the sheet is removed, the insert can be affixed into recess 26 of head 24.

As best shown in FIGS. 4 and 5, the shaft 12 fits around metal insert 22 and, in turn, the elastomeric material 24 fits around the shaft 12. This provides a durable club which can be used to strike a golf ball over a continuous period of time without adverse results on the club.

In a preferred method of construction, a metal insert, preferably a metal rod, is bent and configured into a shape desired to provide the configuration, including loft angle of the club desired. Although a metal rod is preferred, other metal inserts such as bar metal can be utilized. It is also possible to utilize composites, such as metal chips in a polymer, metal sinters and the like, which materials are included in the term "metal" as used herein. After shaping, the metal insert is placed into a mold and a metal shaft is placed over the end of the metal insert. Thereafter, an elastomeric material is molded around the metal insert and the tip end of the shaft so as to provide an integral structure having the shape desired. Preferably, as shown in FIG. 7, the mold will be designed in order that a recess is formed at the surface of the club head opposite the striking face of the club. Thereafter, pad 30 can be fitted into the recess to form the finished club. The indent also can be used as a means to modify the weight of the club, and when the pad is not used, a suitable surface for affixing logos, etc.

The club has all of the characteristics of an authentic golf club. However, the golf club, being of an elastomeric material and particularly when the pad 30 is in place, is relatively safe in that if an individual is accidentally struck with the club the impact of the striking will be reduced as a result of the resiliency. A club useful as a teaching club for youths is provided.

Figure 8:
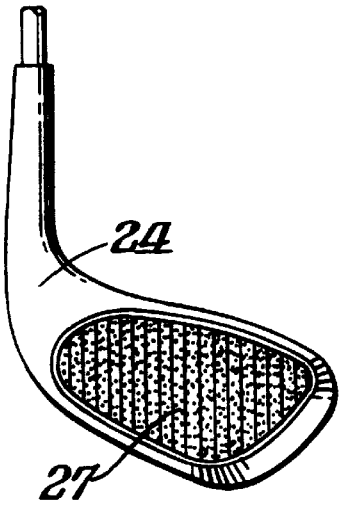
FIG. 8 is a view similar to FIG. 7 but having VELCRO on the back of the striking face in place of the pad shown in FIGS. 1 and 6.
Figure 10:
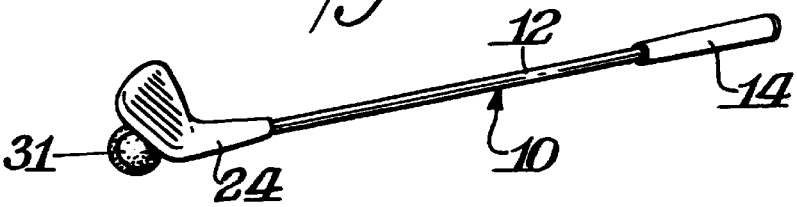
FIG. 10 illustrates a training club as illustrated in FIG. 8 in contact with the training ball illustrated in FIG. 9.

As is apparent, the introductory golf club of the present invention can be utilized to impart different golf skills to the beginning player. As shown in FIG. 8, the club has a VELCRO surface 27 opposite the striking face. The training ball 31 used with the introductory club also has a mated VELCRO surface. The back of the club, because of the VELCRO surface, can be utilized to pick up the ball in that the ball will stick to the surface, as shown in FIG. 10. This permits teaching sessions in a relatively confined area with the golfer being able to pick up the ball from near another golfer without approaching close enough to the other golfer to be accidentally struck by the club. The use of a club and ball with mated VELCRO surfaces also contributes to the enjoyment of the game by a beginner golfer.

Figure 12:
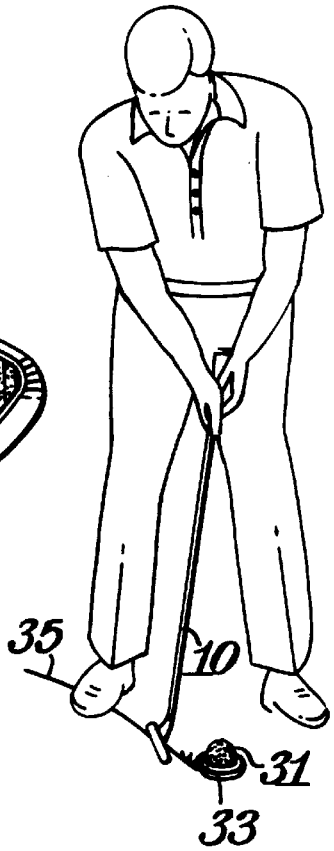
FIG. 12 illustrates how the component shown in FIG. 11 can be used to teach the golfer the proper stance and proper placement of his feet.
Figure 11:
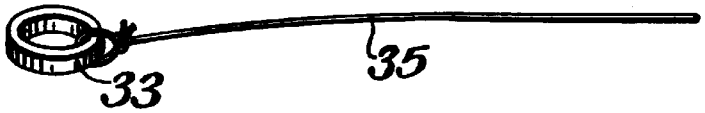
FIG. 11 is a component useful when teaching a beginning golfer proper foot position.

FIG. 11 illustrates a ring 33 at the end of a string 35. The string can be of different lengths and is designed to teach the golfer the proper stance and proper placement of his feet as shown in FIG. 12. Thus, the training golf ball is inserted into the ring 33 and functions as a tee. Also, however, the string can be used by the golf instructor to require the golfer to properly place his feet for different aspects of the game.

Figure 13:
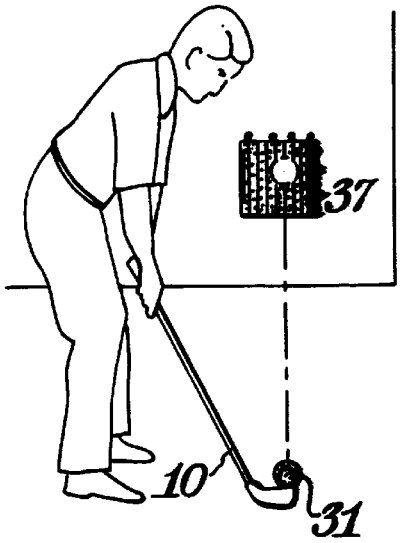
FIG. 13 illustrates a training device comprising a VELCRO pad and the VELCRO ball shown in FIG. 9 to teach accuracy.
Figure 9:
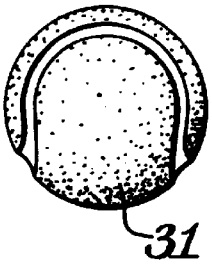
FIG. 9 is a training ball for use with the club shown in FIG. 8 having a VELCRO surface mated to the VELCRO surface on the club shown in FIG. 8.

Shown in FIG. 13 is a VELCRO board 37 which can be placed on a wall surface in a gymnasium with the golfer then being instructed to hit the square surface. In using a VELCRO ball 31 as shown in FIG. 9 the ball will stick to the VELCRO square 37, again enhancing the enjoyment of the game to the golfer while at the same time teaching accuracy.

As will be apparent to one skilled in the art, various modifications can be made within the scope of the aforesaid description. Such modifications being within the ability of one skilled in the art form a part of the present invention and are embraced by the appended claims.

It is claimed:

1. A golf club comprising:

a metal insert;

an elastomeric material molded around said metal insert and shaped into the configuration of the golf club head, said elastomeric material having a striking surface and a surface opposite the striking surface with a recessed area therein;

a pad positioned and affixed in the recessed area of said elastomeric material, said pad having a softness softer than the softness of said elastomeric material; and a shaft affixed to said metal insert and elastomeric material.

2. The golf club of claim 1 wherein said metal insert is a metal rod and the golf club head has a configuration of one of a golf club iron.

3. The golf club of claim 1 wherein said shaft is fitted over said metal insert and said elastomeric material is molded around said metal insert and said shaft.

4. The golf club of claim 1 wherein said elastomeric material at the recessed area of the surface opposite the striking surface has a hook and loop fastening material for affixing said pad in the recessed area.

5. The golf club of claim 1, wherein the golf club has a weight of less than twelve ounces.

6. The golf club of claim 5, wherein the golf club has a weight in the range of nine to twelve ounces.

7. A method of forming a golf club comprising the steps of:

(a) shaping a metal insert ;

(b) fitting a golf club shaft over the end of said metal;

(c) molding an elastomeric material around said metal insert and said shaft end fitted to said metal insert in the form of a golf club, said elastomeric material having a striking surface and a surface opposite the striking surface with a recessed area therein; and (d) positioning and affixing a pad in the recessed area of said elastomeric material, said pad having a softness softer than the softness of said elastomeric material.

8. The method of claim 7, wherein the golf club has a weight of less than twelve ounces.

9. The method of claim 8, wherein the golf club has a weight in the range of nine to twelve ounces.

10. The method of claim 7, wherein said metal insert is a metal rod and the golf club head has a configuration of one of a golf club iron.

11. The method of claim 7, wherein said elastomeric material at the recessed area of the surface opposite the striking surface has a hook and loop fastening material for affixing said pad in the recessed area.

* * * * *